US008505636B2

(12) United States Patent
Schepp et al.

(10) Patent No.: US 8,505,636 B2
(45) Date of Patent: Aug. 13, 2013

(54) WELLHEAD ASSEMBLY HAVING A NESTED TUBING HEAD

(76) Inventors: Douglas Wade Schepp, Airdrie (CA); Scott Travis Webster, Airdrie (CA)

( * ) Notice: Subject to any disclaimer, the term of this patent is extended or adjusted under 35 U.S.C. 154(b) by 0 days.

(21) Appl. No.: 13/194,720

(22) Filed: Jul. 29, 2011

(65) Prior Publication Data

US 2013/0025848 A1 Jan. 31, 2013

(51) Int. Cl.
*E21B 19/00* (2006.01)

(52) U.S. Cl.
USPC ..... 166/379; 166/75.14

(58) Field of Classification Search
USPC ..... 166/379, 85.1, 85.4, 75.13, 75.14
See application file for complete search history.

(56) References Cited

U.S. PATENT DOCUMENTS

| | | | | |
|---|---|---|---|---|
| 3,250,331 | A | 5/1966 | Boyle | |
| 4,278,278 | A | 7/1981 | Chambless | |
| 4,791,986 | A | 12/1988 | Vallet | |
| 5,092,401 | A | 3/1992 | Heynen | |
| 5,327,965 | A | 7/1994 | Stephen et al. | |
| 6,065,542 | A * | 5/2000 | Lalor et al. | 166/348 |
| 6,571,877 | B1 | 6/2003 | Van Bilderbeek | |
| 6,715,555 | B2 * | 4/2004 | Milberger et al. | 166/368 |
| 7,419,001 | B2 | 9/2008 | Broussard | |
| 2004/0079532 | A1 * | 4/2004 | Allen et al. | 166/379 |
| 2005/0167095 | A1 * | 8/2005 | Nguyen | 166/88.2 |
| 2005/0284640 | A1 * | 12/2005 | Borak, Jr. | 166/369 |
| 2007/0102150 | A1 * | 5/2007 | McGuire et al. | 166/75.13 |
| 2008/0185156 | A1 | 8/2008 | Rodgers et al. | |
| 2009/0107685 | A1 * | 4/2009 | Cain et al. | 166/379 |
| 2010/0288483 | A1 | 11/2010 | Cain et al. | |

FOREIGN PATENT DOCUMENTS

EP 0316071 A2 5/1989

* cited by examiner

*Primary Examiner* — David Bagnell
*Assistant Examiner* — Taras P Bemko
(74) *Attorney, Agent, or Firm* — Workman Nydegger

(57) ABSTRACT

A wellhead assembly includes a casing head and a tubing head that is landed within the casing head when the tubing head is landed. The casing head has top and bottom ends, and its bottom end is coupled to surface casing. The tubing head also has top and bottom ends, and its bottom end is coupled to an additional casing string, such as production casing. The tubing head can be landed on the casing head through a blowout preventer.

29 Claims, 12 Drawing Sheets

WELLHEAD ASSEMBLY HAVING A NESTED TUBING HEAD

TECHNICAL FIELD

The present disclosure is directed at a wellhead assembly having a nested tubing head. More particularly, the present disclosure is directed at such an assembly in which the nested tubing head can be landed, through a blowout preventer, within a casing head.

BACKGROUND

In oil and gas drilling, a wellhead typically refers to a series of spools, valves and adapters that are located at the surface of a wellbore and that provide pressure control for the wellbore. During production, a wellhead typically includes a casing head, a tubing head that is landed on the casing head, and a series of valves, spools, pressure gauges and the like (a "Christmas tree") mounted on top of the tubing head and used to control the flow of formation fluids out of the wellbore. Often, during drilling, in lieu of the Christmas tree a blowout preventer may be mounted on the tubing head. The blowout preventer is used to safely deal with extremes in pressure that may be unexpectedly encountered during drilling.

Because of the nature of the equipment used and the dangers associated with oil and gas drilling, installing and changing the configuration of wellheads is a time consuming, potentially dangerous, and costly process. Accordingly, research and development continues into improving the deployment and design of wellheads.

SUMMARY

According to a first aspect, there is provided a wellhead assembly that includes a casing head having top and bottom ends, wherein the bottom end of the casing head is coupled to surface casing; and a tubing head having top and bottom ends, wherein the bottom end of the tubing head is coupled to an additional casing string and the tubing head is fixedly coupled to and landed within the casing head.

The tubing may include a threaded portion that includes the top end of the tubing head, and the top end of the tubing head may extend past the top end of the casing head.

The wellhead assembly may also include a tubing hanger contained within the tubing head and coupled to production tubing. The tubing hanger can have an outer surface comprising a lower tubing hanger shoulder and the tubing head can have an inner surface comprising a production tubing support shoulder, wherein the lower tubing hanger shoulder rests on the production tubing support shoulder.

The threaded portion of the tubing head may include a tubing head lock screw port, the outer surface of the tubing hanger may include an upper tubing hanger shoulder aligned with the lock screw port, and the wellhead assembly may also include a completion flange screwed on to the threaded portion of the tubing head that includes a completion flange lock screw port aligned with the tubing head lock screw port; and a lock screw extending through the tubing head and completion flange lock screw ports and abutting against the upper tubing hanger shoulder.

The casing head may include an inner surface having a casing head shoulder, the tubing head may include an outer surface having a tubing head shoulder, and the tubing head shoulder may rest on the casing head shoulder.

The tubing head may be fluted and the casing head may include an outlet plug that extends into the interior of the casing head and into a flute on the tubing head.

The tubing head may also include a body across which extends a tubing head annulus access port allowing access to the interior of the tubing head, and the casing head can also include a body across which extends a casing head annulus access port aligned with the tubing head annulus access port.

The tubing head may also include an o-ring seal circumscribing the interior of the tubing head and located between the additional casing string and the tubing head annular access port.

The wellhead assembly may also include a seal pack-off assembly located in an outermost annulus between the exterior of the tubing head and the interior of the casing head and positioned to isolate the tubing head annulus access port; a primary seal located in the outermost annulus on top of the seal pack-off assembly; and a retaining ring located in the outermost annulus and screwed into the top end of the casing head above the primary seal.

According to another aspect, there is provided a tubing head that includes a substantially cylindrical body having an inner surface and an outer surface; a production tubing support shoulder located on the inner surface and shaped to allow landing of a tubing hanger having a tubing hanger shoulder on its exterior that is shaped to mate with the production tubing support shoulder; and a tubing head shoulder located on the outer surface and shaped to allow the tubing head to be landed within a casing head having a casing head shoulder on its interior that is shaped to mate with the tubing head shoulder.

The body may have top and bottom ends, and the tubing head may also include a threaded portion on the outer surface that includes the top end.

The threaded portion may include a tubing head lock screw port extending from the outer surface to the inner surface. The outer surface may be fluted.

The tubing head may also include a tubing head annulus access port positioned between the top and bottom ends and extending from the outer surface to the inner surface.

Additionally, the tubing head may include an o-ring seal circumscribing the inner surface and located between the tubing head annulus access port and the bottom end.

According to another aspect, there is provided a method for assembling a wellhead assembly, the wellhead assembly including a casing head on top of which is coupled a blowout preventer (BOP), and the method including running a tubing head through the BOP and into the casing head; and landing the tubing head within the casing head.

The casing head may include an outlet plug extending inwardly into the casing head and running the tubing head into the casing head may include aligning a flute on an outer surface of the tubing head with the outlet plug.

The method may also include running a seal pack-off assembly to an outermost annulus between the tubing and casing heads by detachably coupling a bit guide to the seal pack-off assembly; running the bit guide and the seal pack-off assembly through the BOP until the seal pack-off assembly is landed within the outermost annulus; detaching the bit guide from the seal pack-off assembly; and lifting the bit guide out of the outermost annulus.

The method may also include landing a tubing hanger within the tubing head on a production tubing support shoulder on an inner surface of the tubing head.

The tubing head may include a top end extending out of the casing head and a threaded portion that includes the top end, and the method may also include screwing a completion flange to the threaded portion.

The tubing head may also include a body across which extends a tubing head annular access port allowing access to the interior of the tubing head; the casing head can have a body across which extends a cashing head annulus access port aligned with the tubing head annulus access; and the method can also include accessing an annulus contained within the tubing head through the tubing head and casing head annulus access ports.

BRIEF DESCRIPTION OF THE DRAWINGS

In the accompanying drawings, which illustrate one or more exemplary embodiments.

DETAILED DESCRIPTION

Directional terms such as "top," "bottom," "upwards," "downwards," "vertically" and "laterally" are used in the following description for the purpose of providing relative reference only, and are not intended to suggest any limitations on how any article is to be positioned during use, or to be mounted in an assembly or relative to an environment.

In oil and gas drilling, a wellhead is located at the top of a wellbore. During production, a conventional wellhead includes a casing head that is coupled, for example via welding, to surface casing that lines a portion of the wellbore and that extends out the top of the wellbore. A tubing head is landed on and is bolted to a flange located on top of the casing head. The tubing head supports a tubing hanger from which production tubing can be hung. A Christmas tree, which is used to direct formation fluids obtained from the wellbore, is mounted on to the tubing head. During drilling, a blowout preventer (BOP) may be mounted on the tubing head in lieu of the Christmas tree.

Prior to attaching the tubing head to the casing head, in a conventional assembly the BOP is often already mounted directly to the casing head. Consequently, in order to mount the tubing head to the casing head, the BOP is nippled-down, the tubing head is mounted to the casing head, and the BOP is then nippled-up from the tubing head. This process is cumbersome, time consuming, and risky. For example, while the BOP is removed from the tubing head there is an increased risk of a blowout occurring. Additionally, a limited amount of space is available under a rig's substructure, which is where the BOP is located. Nippling-down and then nippling-up the BOP involves changing the height of the BOP, which may involve modifying the rig's height; this takes time and adds cost and risk to the process.

The embodiments described herein are directed at an assembly for use as a portion of a wellhead ("wellhead assembly"). The wellhead assembly includes a casing head and a tubing head that is landed within, and is accordingly at least partially nested within, the casing head. The nested tubing head can be landed within the casing head through a BOP while the BOP is mounted directly to the casing head. Accordingly, the BOP does not have to nippled-down and then nippled-up when the tubing head is installed, and using the embodiments described herein is consequently quicker and safer than using many conventional wellhead assemblies. In some embodiments, the tubing head described herein also allows the annulus between production tubing and casing to be directly accessed through the walls of the casing and tubing heads in addition to through the top of the wellhead assembly, which is the sole manner in which this annulus can be accessed in some conventional wellhead assemblies. FIGS. 1 to 10 generally illustrate one exemplary embodiment of how the wellhead assembly can be assembled through the BOP.

Figure 1:
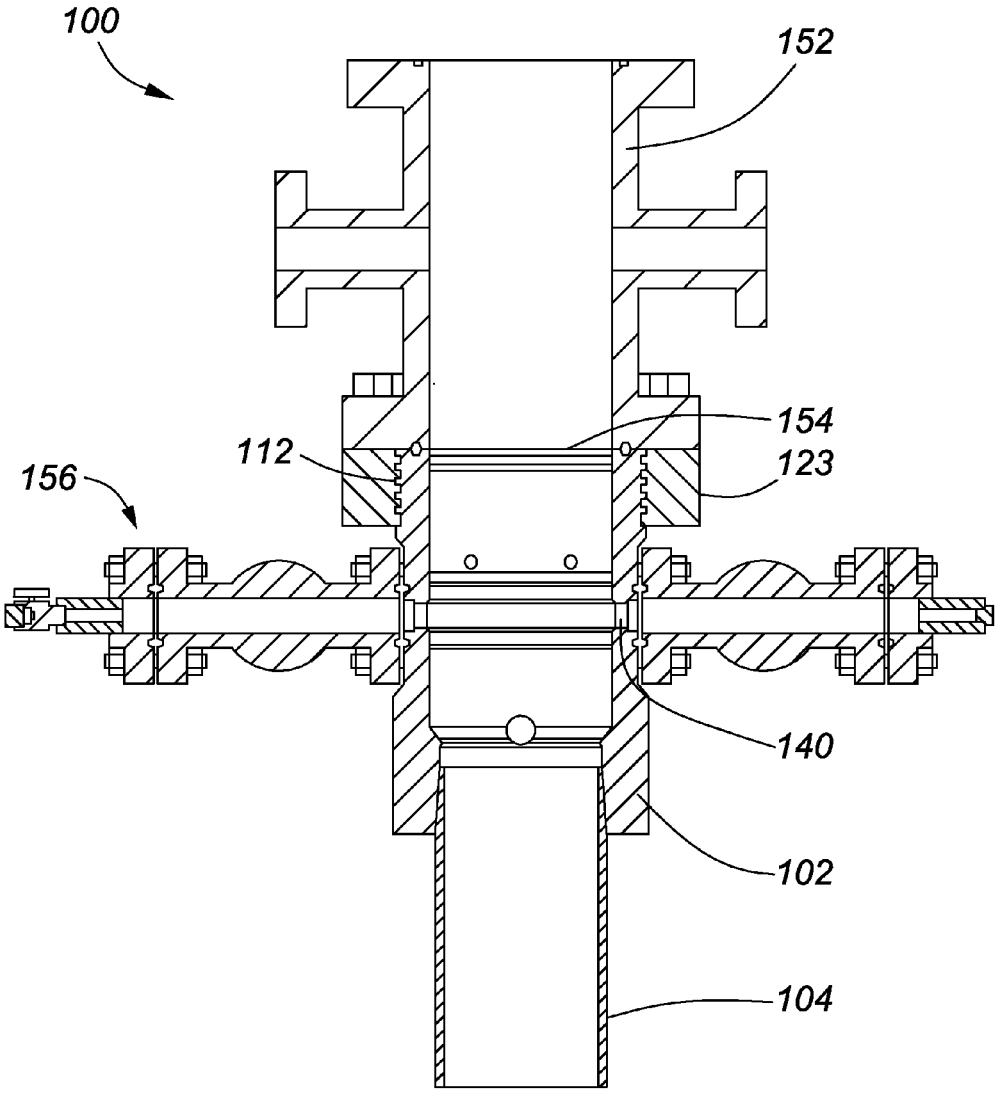
FIG. 1 depicts a front sectional view of a casing head that is coupled to surface casing and that is nippled up to a blowout preventer, according to one embodiment.

Referring now in particular to FIG. 1, there is shown a front sectional view of a casing head 102 having a substantially cylindrical body that has top and bottom ends. The casing head 102's bottom end is threaded and is threadably coupled to the top end of a segment of surface casing 104; this coupling can be performed using any suitable running tool. The top end of the casing head 102 has an interior threaded portion 154 and an exterior threaded portion 112. As discussed in further detail below, the interior threaded portion 154 can be used when a retaining ring is screwed into the casing head 102 during well completion. Various flanges or the like can be screwed on to the exterior threaded portion 112 of the casing head 102. In FIG. 1, a drilling adaptor 123 is screwed on to the exterior threaded portion 112, and a BOP 152 is nippled-up from the drilling adaptor 123.

Extending across the walls of the casing head 102's body are casing head annular access ports 140. The casing head annular access ports 140 allow the portion of the wellbore contained within the surface casing 102 to be accessed through the casing head 102's walls as opposed to from above the casing head 102 and along the wellbore, via the BOP 152. Coupled to the casing head annular access ports 140 in FIG. 1 are annulus gate valves and companion flanges 156 through which the casing head annulus access ports 140 can be accessed.

Figure 2:
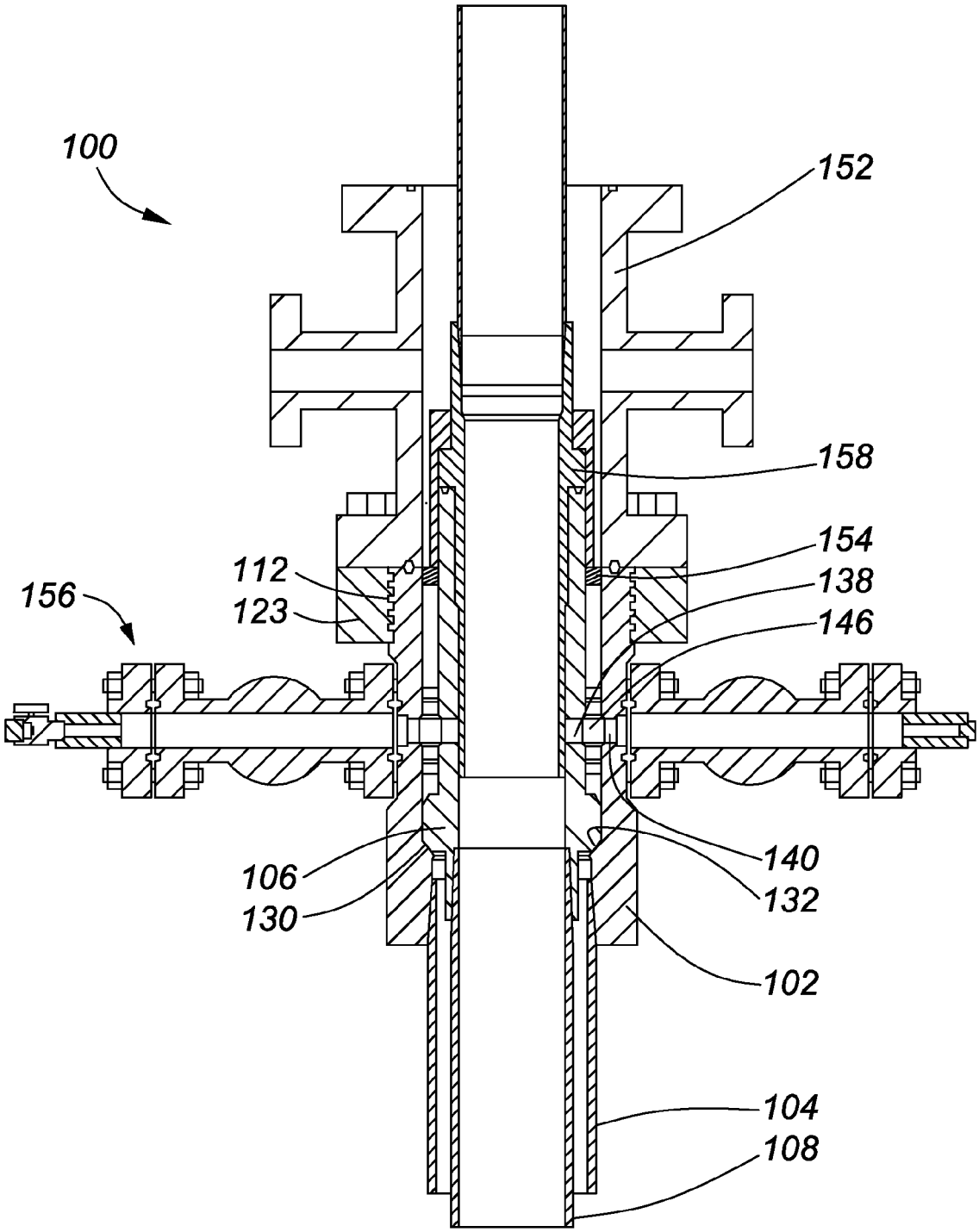
FIG. 2 depicts a front sectional view of a wellhead assembly that includes the casing head of FIG. 1 and in which a running tool is being used to run a tubing head through the blowout preventer and into place within the casing head.

Referring now to FIG. 2, there is shown a front sectional view of a wellhead assembly 100 according to a first embodiment. A running tool 158 that is being used to run a tubing head 106 into the casing head 102 and to land the tubing head 106 within the casing head 102. The bottom end of the tubing head 106 is first threadably coupled to a segment of production casing 108, and a threaded portion 110 (not shown in FIG. 2, but shown and discussed in respect of FIGS. 3 and 4, below) on the top end of the tubing head 106 is then threadably coupled to threads lining the interior of the running tool 158. Near its bottom end, the tubing head 106 also has a tubing head shoulder 132 on its outer surface that is shaped to mate with a casing head shoulder 130 that is present on the interior of the casing head 102. In the depicted embodiment both the tubing and casing head shoulders 132, 130 are annular in that they each respectively circumscribe the exterior of the tubing head 106 and the interior of the casing head 102; however, in an alternative embodiment (not depicted) either or both may take another suitable shape (e.g.: one or both may be fluted). The running tool 158 lands the tubing head 106 by running it down the wellbore until the tubing head shoulder 132 abuts against the casing head shoulder 130. Once the tubing head 106 is landed, an outermost annulus 146 between the outer surface of the tubing head 106 and an inner surface of the casing head 102 is cemented.

Figure 3:
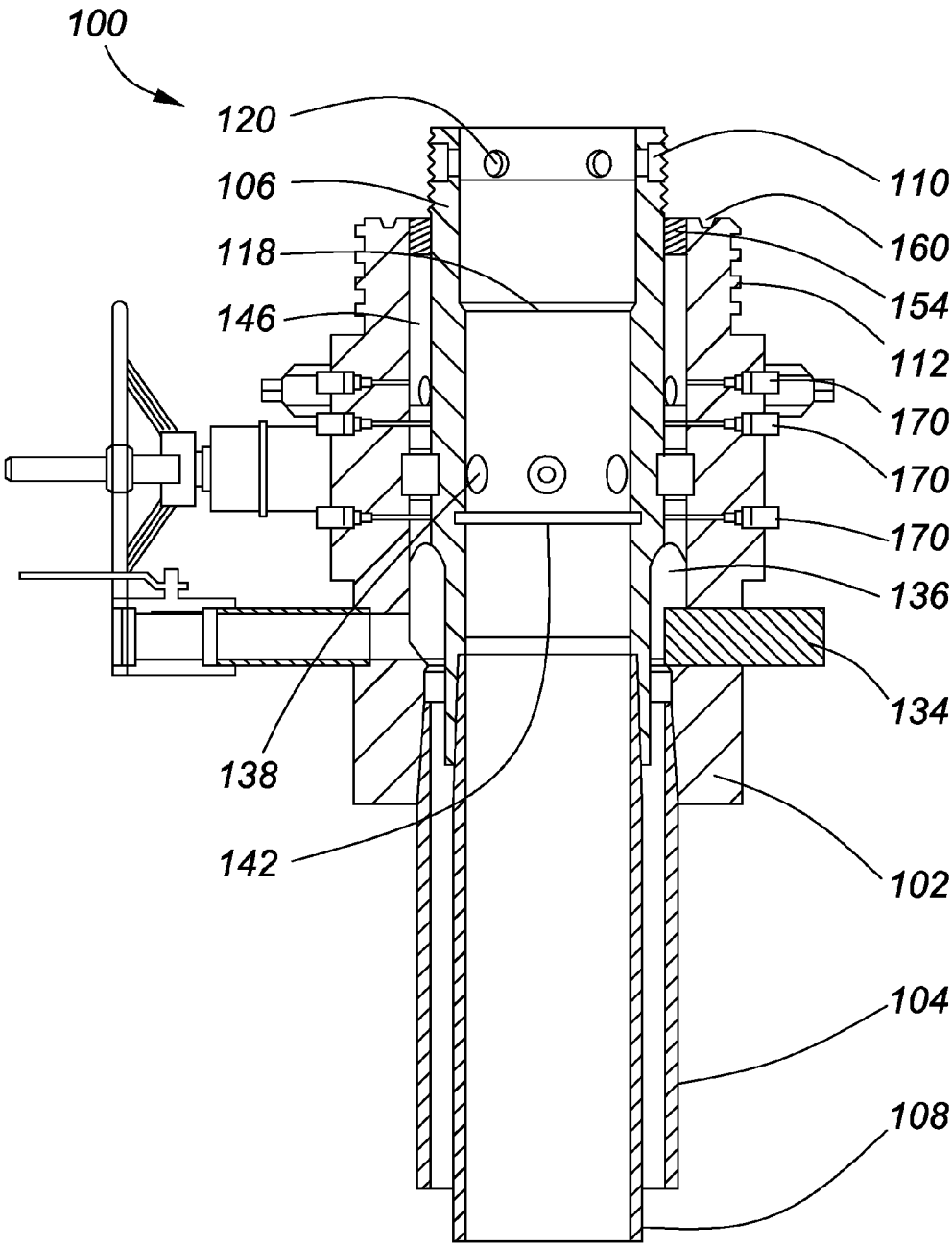
FIG. 3 depicts a side sectional view of the wellhead assembly including the tubing head landed within the casing head.
Figure 4:
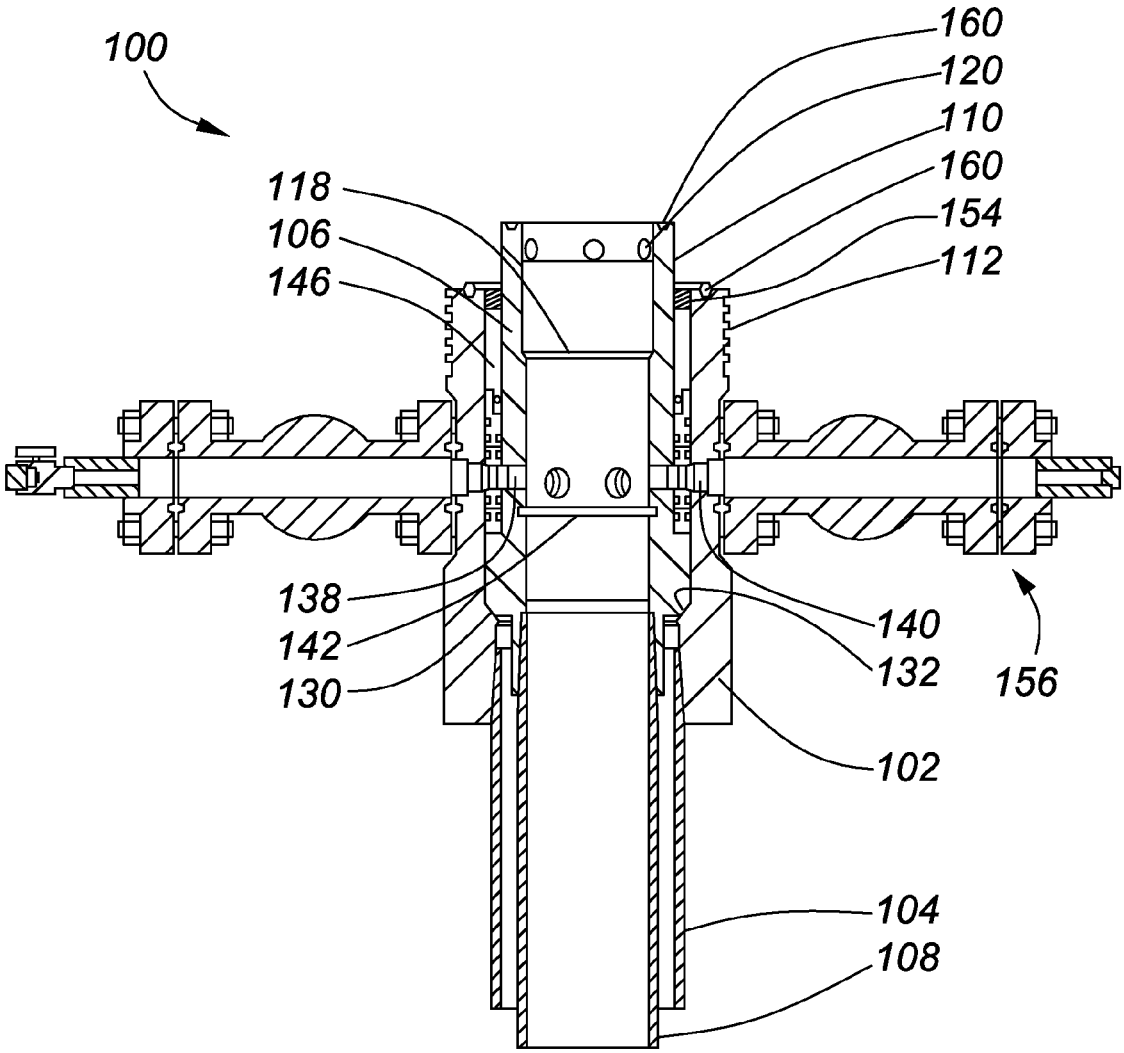
FIG. 4 depicts a front sectional view of the wellhead assembly including the landed tubing head.

Referring now to FIGS. 3 and 4, there are shown side and front sectional views of the landed tubing head 106 once the running tool 158 has been retracted from the wellbore. The BOP 154 is not shown in FIGS. 3 and 4 so that the components of the wellhead assembly 100 may be emphasized for the purpose of explanation; in practice, the BOP 154 remains mounted on the casing head 102 immediately following landing of the tubing head 106, as shown in FIGS. 3 and 4.

The tubing head 106 is manufactured using a substantially cylindrical body. As mentioned above, the tubing head 106's bottom end is threaded to allow it to be coupled to a casing string, which in the depicted embodiment is the production casing 108 but which in an alternative embodiment (not depicted) may be, for example, intermediate casing. The bottom end of the tubing head 106 is also fluted to assist in aligning the tubing head 106 during landing. As shown in FIG. 3, flutes 136 located at and near the bottom end of the tubing head 106 can be aligned with an outlet plug 134 that is extendable through the casing head 102 wall and into the wellbore. When the outlet plug 134 is protruding into the wellbore, the tubing head 106 can only be fully inserted into the casing head 102 when the tubing head 106 is rotated such that the outlet plug 134 fits within one of the flutes 136, as shown in FIG. 3.

Above the flutes 136 are a series of tubing head annulus access ports 138 that are circumferentially spaced around the tubing head 106. Each of the tubing head annulus access ports 138 extends across a portion of the tubing head 106's body; i.e., from the outer surface to the inner surface of the tubing head 106. When the tubing head 106 is landed within the casing head 102, two of the tubing head annulus access ports 138 align with two of the casing head annulus access ports 140. This allows the interior of the tubing head 106 to be accessed across the walls of the casing and tubing heads 102, 106, as opposed to from above the tubing head 106 and along the wellbore. Although in the depicted embodiment two pairs of the tubing and casing head annulus access ports 138, 140 are aligned, in alternative embodiments (not shown) the tubing and casing head annulus access ports 138, 140 may be missing from the wellhead assembly 100, or none or more than one pair of the tubing and casing head annulus access ports 138, 140 may be aligned.

Between the flutes 136 and the tubing head annulus access ports 138, and circumscribing the inner surface of the tubing head 106, is an o-ring seal 142. During cementing of the outermost annulus 146, the running tool 158 presses against the o-ring seal 142 to prevent cement from flowing upwards and blocking the tubing head annulus access ports 138.

The tubing head 106 is also configured so that a tubing hanger 114 (not shown in FIG. 3 or 4, but shown in FIGS. 7 to 10) can be landed within it. For example, approximately halfway between the tubing head annulus access ports 138 and the top end of the tubing head 106 is the production tubing support shoulder 118. The production tubing support shoulder 118, which in the depicted embodiment is annular and circumscribes the interior of the tubing head 106, is used to support the tubing hanger 114 when the tubing hanger 114 is landed within the tubing head 106. Additionally, near the top end of the tubing head 106 are a series of circumferentially spaced tubing head lock screw ports 120, through which lock screws 128 (not shown in FIG. 3 or 4, but shown in FIGS. 9 and 10) can be inserted to abut against and retain the tubing hanger 114. The tubing hanger 114 is discussed in more detail in respect of FIGS. 7 to 10, below.

When landed within the casing head 102, the threaded portion 110 of the tubing head 106 extends past the top end of the casing head 102. The threaded portion 110 of the tubing head 106 begins at the tubing head 106's top end and extends down the tubing head 106 past the tubing head lock screw ports 120. Since the tubing head 106's threaded portion 110 extends past the top end of the casing head 102, a driller has the flexibility to connect additional wellhead equipment to either the top end of the tubing head 106 or the top end of the casing head 102, which are differently sized and which can be rated for different pressures. For example, in the depicted embodiment the threaded portion 110 of the tubing head 106 accommodates a flange having a diameter of 7 1/16" and rated at 2,000, 3,000, 5,000 or 10,000 psi, and the exterior threaded portion 112 of the casing head 102 accommodates a flange having a diameter of 11" and rated at 2,000, 3,000 or 5,000 psi. To be able to accommodate flanges that are rated at different pressures, one or both of ring grooves 160 located on the top end of the tubing head 106 and the casing head 102 can be machined to accommodate flanges of different pressure ratings by increasing or decreasing their diameters so as to be able to receive differently sized gaskets. Beneficially, when only the sizing of the ring grooves 160 is changed, the casing and tubing heads 102, 106 can accommodate different pressures without changing their respective bolt patterns and without requiring changes in the thicknesses of the flanges coupled to them.

Figure 5:
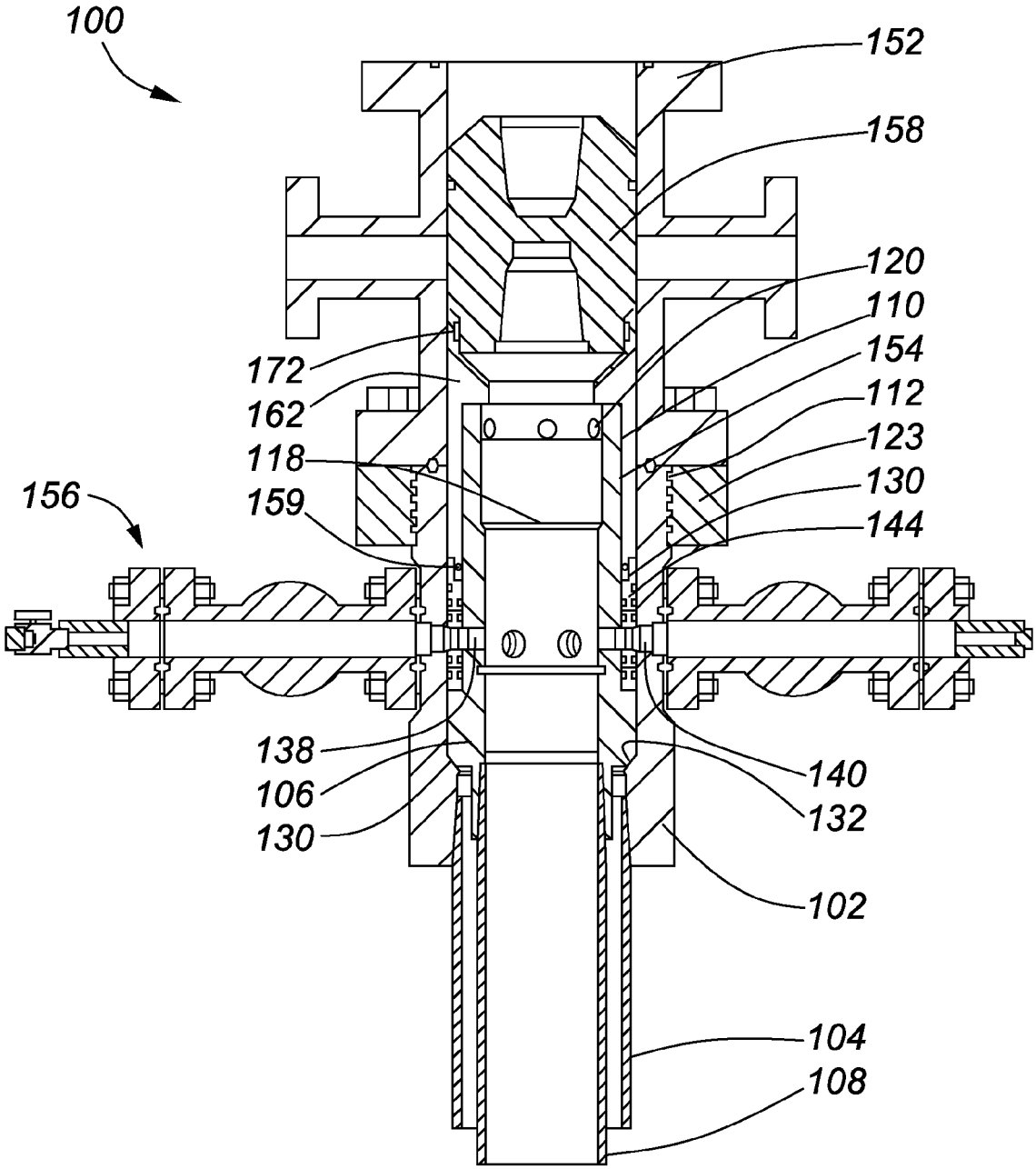
FIG. 5 depicts a front sectional view of the wellhead assembly, including the landed tubing head, and a running tool used to run a seal pack-off assembly into an outermost annulus between the tubing and casing heads.
Figure 6:
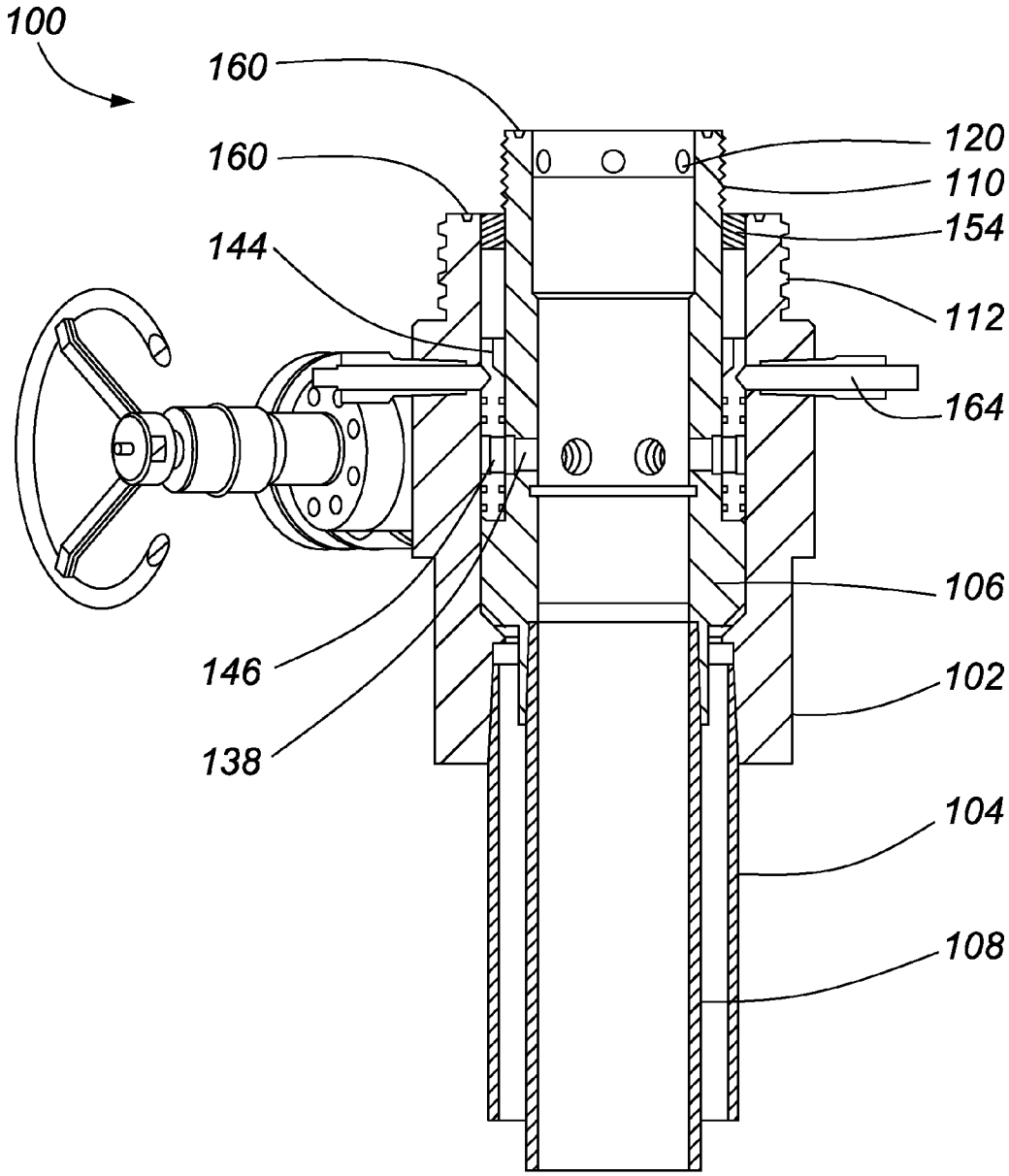
FIG. 6 depicts a sectional view of the wellhead assembly, including the landed tubing head, showing the seal pack-off assembly held in place using lock screws.

Referring now to FIG. 5, a seal pack-off assembly 144 and bit guide 162 are shown being installed into the outermost annulus 146 between the tubing and casing heads 106, 102. The running tool 158 is secured to the top of the bit guide 162 using lift lugs 172, and a threaded bottom 159 of the bit guide 162 is used to detachably couple the bit guide 162 to the seal pack-off assembly 144 by screwing the bit guide 162 to the seal pack-off assembly 144. The running tool 158 is again run through the BOP 152 until the seal pack-off assembly 144 is in place around the tubing head annulus access ports 138. As shown in FIG. 6, lock screws 164 are then screwed into the seal pack-off assembly 144 through the casing head 102 to secure the seal pack-off assembly 144 into place. The seal pack-off assembly 144 can then be tested using test ports 170 in the casing head 102. The seal pack-off assembly 144 isolates the outermost annulus 146 from both the tubing and casing head annulus access ports 138, 140 so that gases from within the production casing 108 do not escape to the surface through the outermost annulus 146. In FIG. 6, the BOP 152 and bit guide 162 are not shown to emphasize the components of the wellhead assembly 100; however, in practice the BOP 152 and the bit guide 162 remain in place until following landing of production tubing, with the bit guide 162 being unscrewed from the seal pack-off assembly 144 and removed immediately prior to removal of the BOP 152, as discussed in further detail below with respect to FIGS. 7 and 8.

Figure 7A:
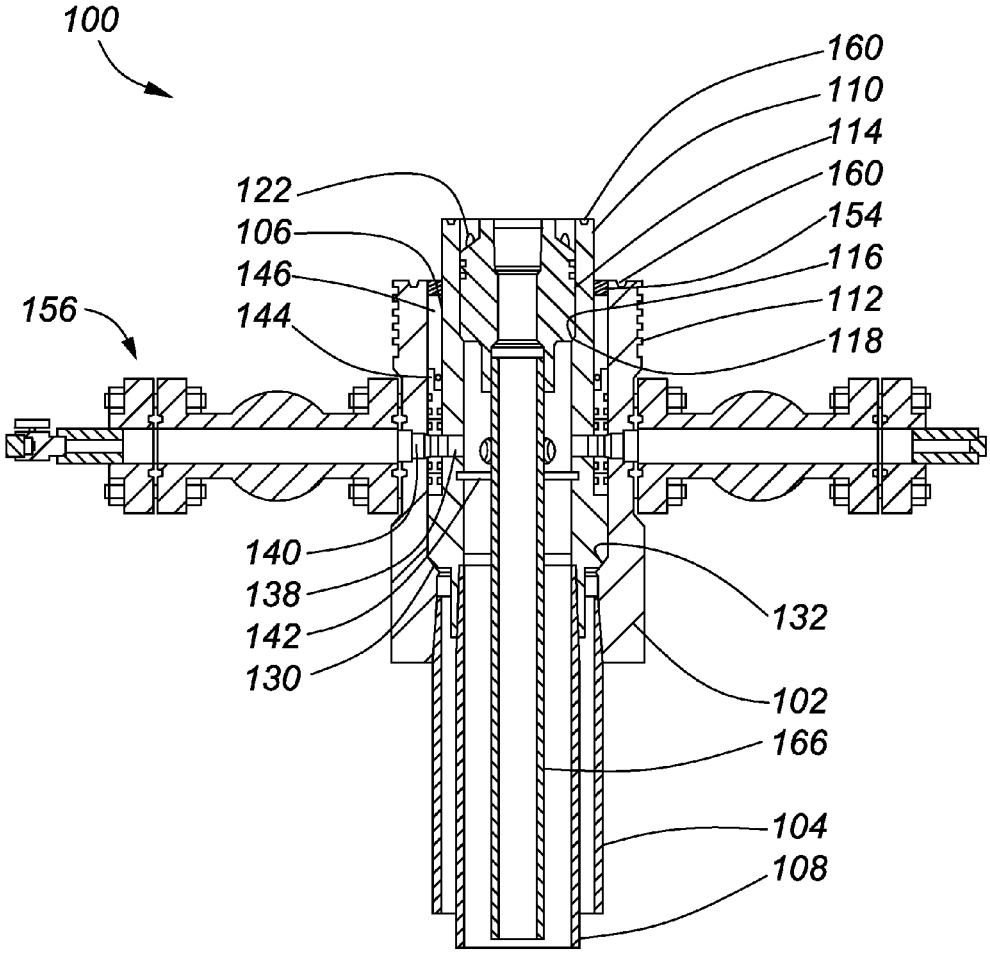
FIGS. 7(*a*) and 7(*b*) respectively depict a front sectional view and a cutaway view of the wellhead assembly, including the landed tubing head and a tubing hanger landed within the tubing head and supporting production tubing.
Figure 7B:
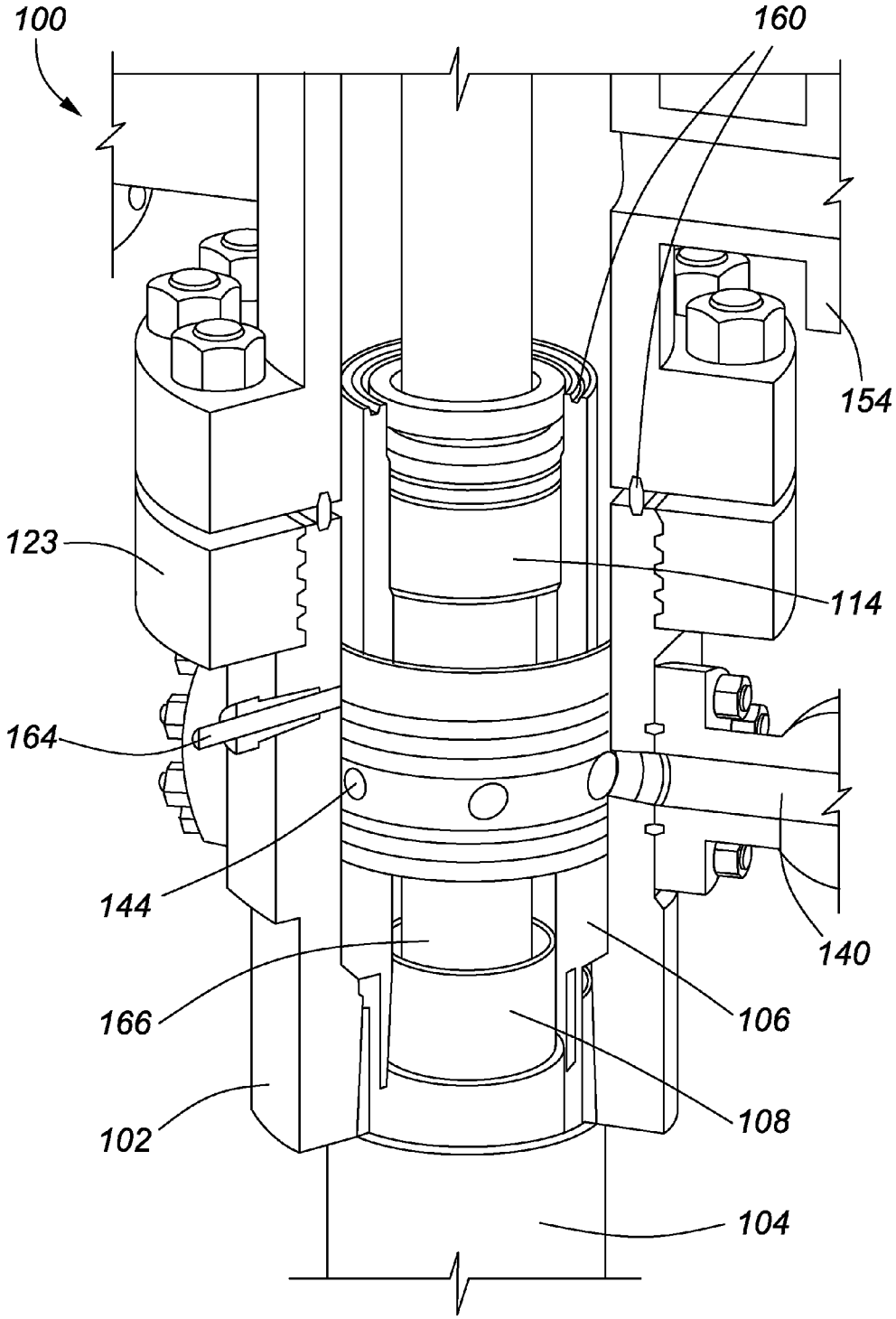
Figure 8:
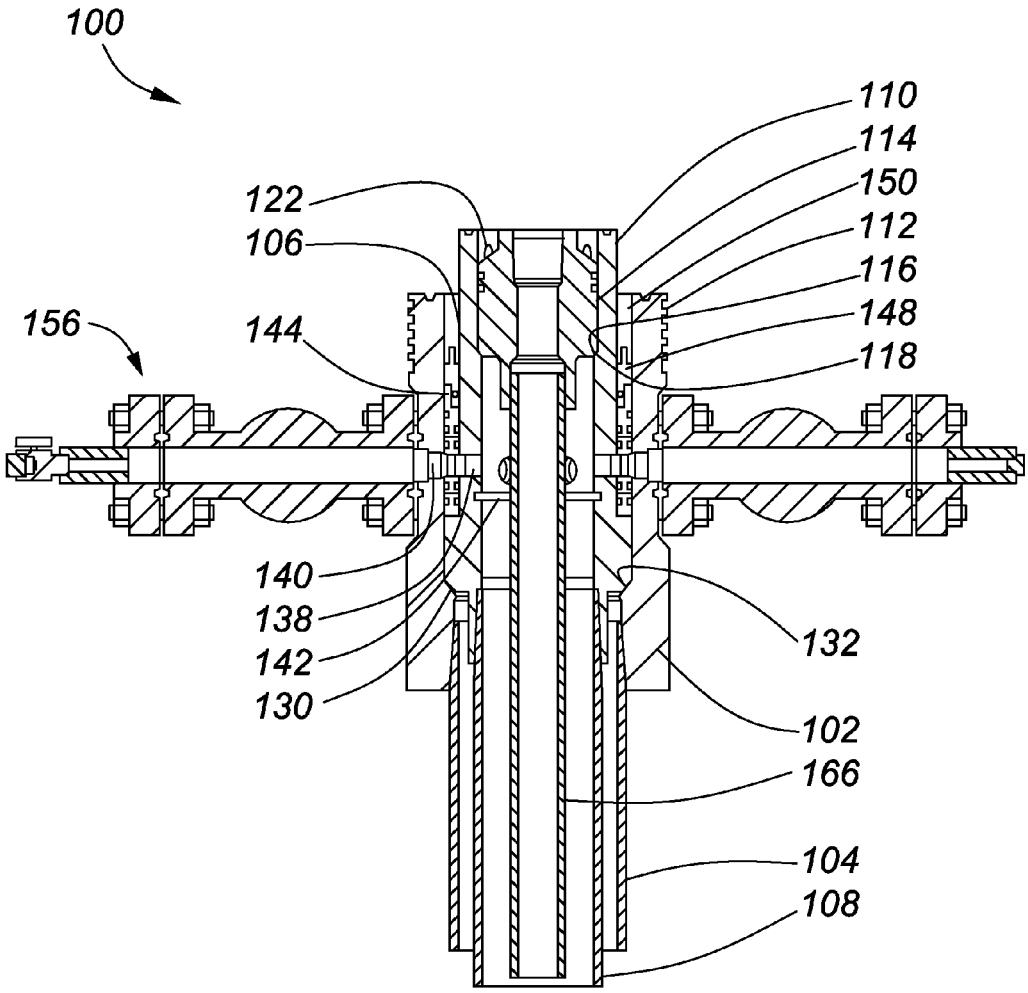
FIG. 8 depicts a front sectional view of the wellhead assembly shown in FIG. 7 that also includes a primary seal and retaining ring located in the outermost annulus above the seal pack-off assembly.

Once the bit guide 162 and seal pack-off assembly 144 are securely in place, drilling can continue with the bit guide 162 protecting the tubing head 106. When drilling has been completed and the well is ready to produce, a tubing hanger 114 is connected to production tubing 166 and is landed within the tubing head 106 as shown in FIGS. 7(*a*), 7(*b*), and 8. The tubing hanger 114 includes an annular lower tubing hanger shoulder 116 on its outer surface that is shaped to mate with and accordingly land on an annular production tubing support shoulder 118 on the tubing head 106's inner surface. Once landed, the bit guide 162 is removed by lifting it out of the outermost annulus 146; FIGS. 7(*a*) and 7(*b*) show the wellhead assembly 100 immediately following removal of the bit guide 162. Following removal of the bit guide 162 and as shown in FIG. 8, a primary seal 148 is screwed into the outermost annulus 146 above the seal pack-off assembly 144 and a retaining ring 150 is screwed into the interior threaded portion 154 of the casing head 102 over the primary seal 148 to prevent the primary seal 148 from traveling upwards.

In a conventional wellhead assembly, the bit guide is permanently attached to the seal pack-off assembly and remains in the outermost annulus 146 following well completion. Because in a conventional wellhead assembly the tubing head is not nested within the casing head, the bit guide does not extend past the top of the tubing head and protects only the casing head and not the tubing head. In contrast, in the embodiments herein in which the tubing head 106 is nested within the casing head 102, the bit guide 162 beneficially extends past the top end of the tubing head 106 to also protect the tubing head 106 during drilling. Accordingly, to allow equipment to be coupled directly to the threaded portion 110 of the tubing head 106 the bit guide 162 is configured to be detachable from the seal pack-off assembly 144 and removable from the wellhead assembly 100. This allows the bit guide 162 to protect the tubing head 106 while being partially located within the outermost annulus 146 as opposed to being located entirely above the tubing head 106, which helps to keep the height of the wellhead assembly 100 relatively low and decrease the likelihood that the height of the rig will have to be changed.

Figure 9:
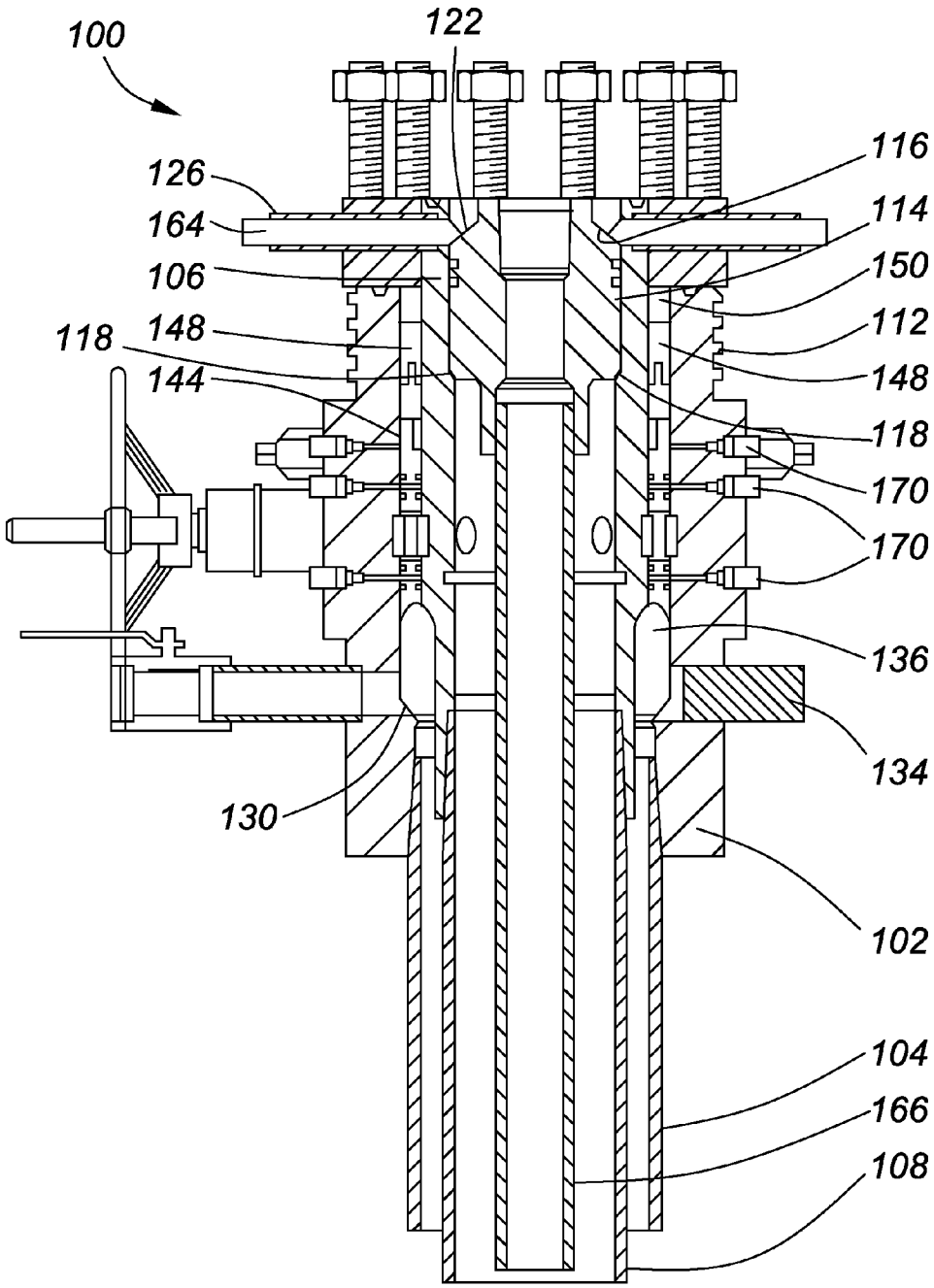
FIG. 9 depicts a side sectional view of the wellhead assembly shown in FIG. 8 that also includes a completion flange screwed on to the tubing head and lock screws inserted through the completion flange to retain the tubing head.
Figure 10:
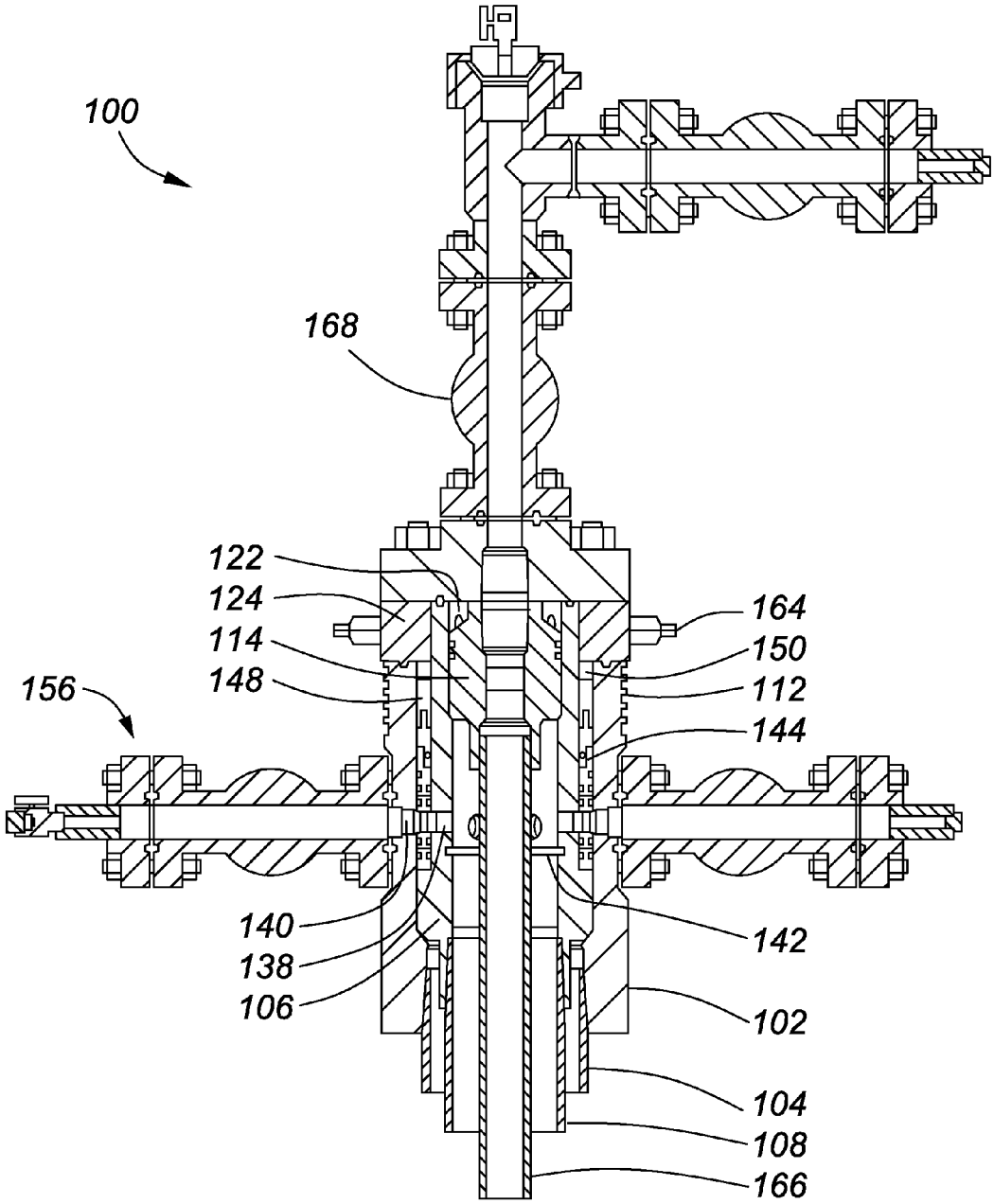
FIG. 10 depicts a front elevation view of the wellhead assembly of FIG. 9 having completion work-over equipment attached to it.

As with FIGS. 3 and 4, in FIGS. 7(*a*), 7(*b*) and 8 the BOP 154 is not shown so that the components of the wellhead assembly 100 may be emphasized for the purpose of explanation; however, in practice the BOP 154 remains mounted on the casing head 102 until FIG. 9.

Referring now to FIG. 9, the BOP 154 has been removed and a completion flange 124 is screwed on to the threaded portion 110 of the tubing head 106. The completion flange 124 includes a series of circumferentially spaced completion flange lock screw ports 126, two of which in FIG. 9 are aligned with two of the tubing head lock screw ports 120 when the completion flange 124 is fully screwed on to the tubing head 106. The tubing hanger 114 has an upper tubing hanger shoulder 122 that is aligned with the pair of aligned tubing head and completion flange lock screw ports 120, 126. Accordingly, lock screws 164 can be screwed through the tubing head and completion flange lock screw ports 120, 126 until they abut against the upper tubing hanger shoulder 122, thereby helping to prevent both rotational and axial movement of the tubing hanger 114 within the tubing head 106.

Once the tubing hanger 114 has been secured, various pieces of equipment may be nippled-up from the completion flange 124 as desired. For example, in FIG. 10 completion work-over equipment 168 is bolted to the completion flange 124. However, in alternative embodiments (not shown), other suitable valves, spools, or adaptors, such as a complete Christmas tree, may instead be attached to the completion flange 124.

Figure 11:
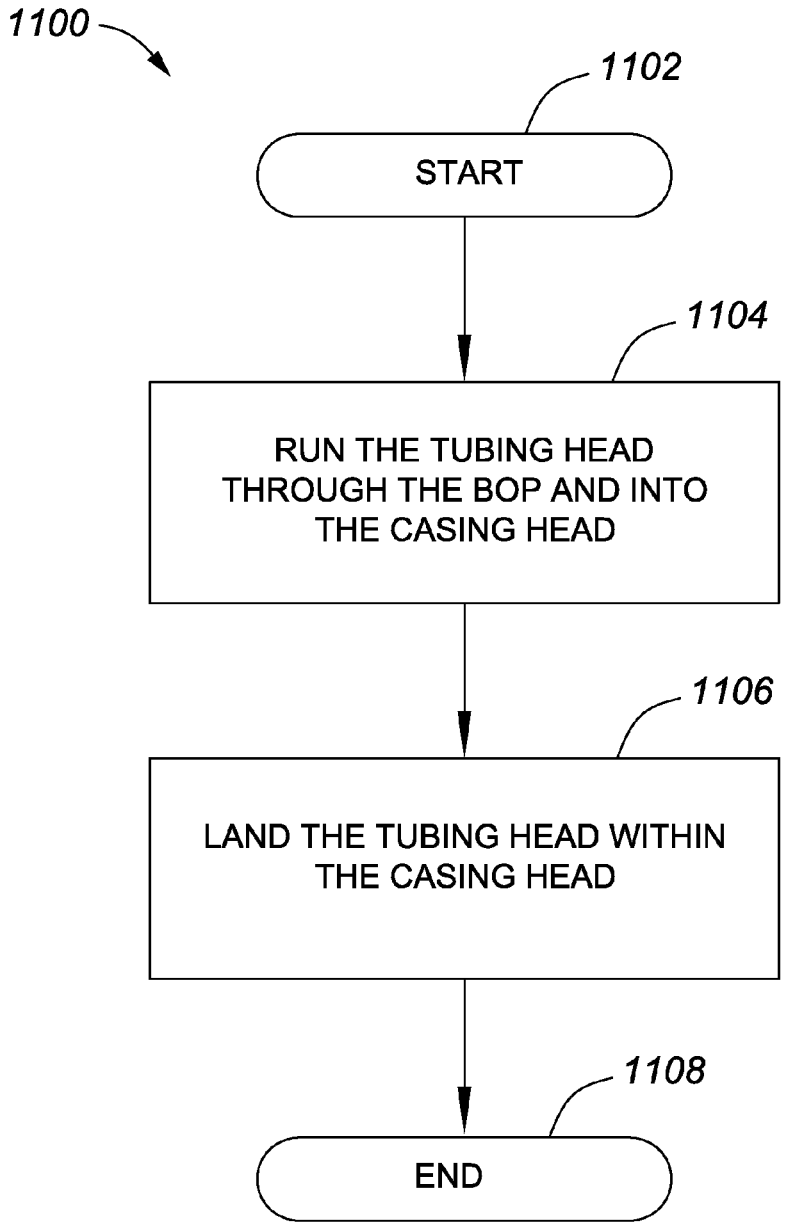
FIG. 11 depicts a method for assembling a wellhead assembly, according to another embodiment.

FIG. 11 depicts a method 1100 for assembling the wellhead assembly 100, according to one embodiment. The method 1100 starts at block 1102 and, as described above, the method 1100 then includes running the tubing head 106 through the BOP 152 and into the casing head 102 (block 1102). Once in the casing head 102, the tubing head 106 is landed within the casing head 102 (block 1104), following which the method 1100 ends at block 1108. In alternative embodiments, as described above, the method 1100 may include various other blocks, such as landing the tubing hanger 114 or installing the completion work-over equipment 168.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. A wellhead assembly, comprising:

(a) a casing head having top and bottom ends, wherein the bottom end of the casing head is coupled to surface casing;

(b) a tubing head having top and bottom ends, wherein the bottom end of the tubing head is coupled to an additional casing string and the tubing head is fixedly coupled to and landed within the casing head, wherein the tubing head comprises a threaded portion that includes the top end of the tubing head, and wherein the top end of the tubing head extends past the top end of the casing head; and (c) a tubing hanger contained within the tubing head and coupled to production tubing, the tubing hanger having an outer surface comprising a lower tubing hanger shoulder and the tubing head having an inner surface comprising a production tubing support shoulder, wherein the lower tubing hanger shoulder rests on the production tubing support shoulder, wherein the threaded portion of the tubing head comprises a tubing head lock screw port, the outer surface of the tubing hanger comprises an upper tubing hanger shoulder aligned with the lock screw port;

(d) a completion flange screwed on to the threaded portion of the tubing head, the completion flange comprising a completion flange lock screw port aligned with the tubing head lock screw port; and (e) a lock screw extending through the tubing head and completion flange lock screw ports and abutting against the upper tubing hanger shoulder.

2. A wellhead assembly as claimed in claim 1 wherein the casing head comprises an inner surface having a casing head shoulder, the tubing head comprises an outer surface having a tubing head shoulder, and the tubing head shoulder rests on the casing head shoulder.

3. A wellhead assembly as claimed in claim 1 wherein the tubing head is fluted and the casing head comprises an outlet plug that extends into the interior of the casing head and into a flute on the tubing head.

4. A wellhead assembly as claimed in claim 1 wherein the tubing head further comprises a body across which extends a tubing head annulus access port allowing access to the interior of the tubing head, and the casing head further comprises a body across which extends a casing head annulus access port aligned with the tubing head annulus access port.

5. A wellhead assembly as claimed in claim 4 wherein the tubing head further comprises an o-ring seal circumscribing the interior of the tubing head and located between the additional casing string and the tubing head annulus access port.

6. A wellhead assembly as claimed in claim 4 further comprising:

(a) a seal pack-off assembly located in an outermost annulus between the exterior of the tubing head and the interior of the casing head and positioned to isolate the tubing head annulus access port;

(b) a primary seal located in the outermost annulus on top of the seal pack-off assembly; and (c) a retaining ring located in the outermost annulus and screwed into the top end of the casing head above the primary seal.

7. A wellhead assembly, comprising:

(a) a casing head having top and bottom ends, wherein the bottom end of the casing head is coupled to surface casing;

(b) a tubing head having top and bottom ends, wherein the bottom end of the tubing head is coupled to an additional casing string and the tubing head is fixedly coupled to and landed within the casing head, and wherein the tubing head further comprises a body across which extends a tubing head annulus access port allowing access to the interior of the tubing head, and the casing head further comprises a body across which extends a casing head annulus access port aligned with the tubing head annulus access port;

(c) a seal pack-off assembly located in an outermost annulus between the exterior of the tubing head and the interior of the casing head and positioned to isolate the tubing head annulus access port;

(d) a primary seal located in the outermost annulus on top of the seal pack-off assembly; and (e) a retaining ring located in the outermost annulus and screwed into the top end of the casing head above the primary seal.

8. A wellhead assembly as claimed in claim 7 wherein the tubing head comprises a threaded portion that includes the top end of the tubing head, and wherein the top end of the tubing head extends past the top end of the casing head.

9. A wellhead assembly as claimed in claim 8 further comprising a tubing hanger contained within the tubing head and coupled to production tubing, the tubing hanger having an outer surface comprising a lower tubing hanger shoulder and the tubing head having an inner surface comprising a production tubing support shoulder, wherein the lower tubing hanger shoulder rests on the production tubing support shoulder.

10. A wellhead assembly as claimed in claim 9 wherein the threaded portion of the tubing head comprises a tubing head lock screw port, the outer surface of the tubing hanger comprises an upper tubing hanger shoulder aligned with the lock screw port, and further comprising:

(a) a completion flange screwed on to the threaded portion of the tubing head, the completion flange comprising a completion flange lock screw port aligned with the tubing head lock screw port; and (b) a lock screw extending through the tubing head and completion flange lock screw ports and abutting against the upper tubing hanger shoulder.

11. A wellhead assembly as claimed in claim 7 wherein the casing head comprises an inner surface having a casing head shoulder, the tubing head comprises an outer surface having a tubing head shoulder, and the tubing head shoulder rests on the casing head shoulder.

12. A wellhead assembly as claimed in claim 7 wherein the tubing head is fluted and the casing head comprises an outlet plug that extends into the interior of the casing head and into a flute on the tubing head.

13. A wellhead assembly as claimed in claim 7 wherein the tubing head further comprises an o-ring seal circumscribing the interior of the tubing head and located between the additional casing string and the tubing head annulus access port.

14. A wellhead assembly, comprising:

(a) a casing head having top and bottom ends, wherein the bottom end of the casing head is coupled to surface casing;

(b) a tubing head having top and bottom ends, fixedly coupled to and landed within the casing head, wherein the top end of the tubing head is threaded and comprises a tubing head lock screw port;

(c) a tubing hanger landed within the tubing head, wherein the tubing hanger has an outer surface comprising an upper tubing hanger shoulder aligned with the tubing head lock screw port;

(d) a completion flange screwed on to the top end of the tubing head, the completion flange comprising a completion flange lock screw port aligned with the tubing head lock screw port; and (e) a lock screw extending through the tubing head and completion flange lock screw ports and abutting against the upper tubing hanger shoulder.

15. A wellhead assembly as claimed in claim 14 wherein the top end of the tubing head extends past the top end of the casing head.

16. A wellhead assembly as claimed in claim 15 wherein the tubing head is coupled to production tubing, the outer surface of the tubing hanger comprises a lower tubing hanger shoulder, and the tubing head has an inner surface comprising a production tubing support shoulder, wherein the lower tubing hanger shoulder rests on the production tubing support shoulder.

17. A wellhead assembly as claimed in claim 14 wherein the casing head comprises an inner surface having a casing head shoulder, the tubing head comprises an outer surface having a tubing head shoulder, and the tubing head shoulder rests on the casing head shoulder.

18. A wellhead assembly as claimed in claim 14 wherein the tubing head is fluted and the casing head comprises an outlet plug that extends into the interior of the casing head and into a flute on the tubing head.

19. A wellhead assembly as claimed in claim 14 wherein the tubing head further comprises a body across which extends a tubing head annulus access port allowing access to the interior of the tubing head, and the casing head further comprises a body across which extends a casing head annulus access port aligned with the tubing head annulus access port.

20. A wellhead assembly as claimed in claim 19 wherein the tubing head further comprises an o-ring seal circumscribing the interior of the tubing head and located between the additional casing string and the tubing head annulus access port.

21. A wellhead assembly as claimed in claim 20 further comprising:

(a) a seal pack-off assembly located in an outermost annulus between the exterior of the tubing head and the interior of the casing head and positioned to isolate the tubing head annulus access port;

(b) a primary seal located in the outermost annulus on top of the seal pack-off assembly; and (c) a retaining ring located in the outermost annulus and screwed into the top end of the casing head above the primary seal.

22. A wellhead assembly, comprising:

(a) a casing head having top and bottom ends, wherein the bottom end of the casing head is coupled to surface casing;

(b) a tubing head having top and bottom ends, fixedly coupled to and landed within the casing head, wherein the top end of the tubing head is threaded and comprises a tubing head lock screw port and wherein the tubing head further comprises a body across which extends a tubing head annulus access port allowing access to the interior of the tubing head;

(c) a seal pack-off assembly located in an outermost annulus between the exterior of the tubing head and the interior of the casing head and positioned to isolate the tubing head annulus access port;

(d) a primary seal located in the outermost annulus on top of the seal pack-off assembly; and (e) a retaining ring located in the outermost annulus and screwed into the top end of the casing head above the primary seal.

23. A wellhead assembly as claimed in claim 22 wherein the casing head further comprises a body across which extends a casing head annulus access port aligned with the tubing head annulus access port.

24. A wellhead assembly as claimed in claim 22 wherein the bottom end of the tubing head is coupled to an additional casing string and the tubing head further comprises an o-ring seal circumscribing the interior of the tubing head and located between the additional casing string and the tubing head annulus access port.

25. A wellhead assembly as claimed in claim 22 wherein the top end of the tubing head extends past the top end of the casing head.

26. A wellhead assembly as claimed in claim 22 further comprising a tubing hanger contained within the tubing head and coupled to production tubing, the tubing hanger having an outer surface comprising a lower tubing hanger shoulder and the tubing head having an inner surface comprising a production tubing support shoulder, wherein the lower tubing hanger shoulder rests on the production tubing support shoulder.

27. A wellhead assembly as claimed in claim 26 wherein the top end of the tubing head comprises a tubing head lock screw port, the outer surface of the tubing hanger comprises an upper tubing hanger shoulder aligned with the lock screw port, and further comprising:

(a) a completion flange screwed on to the top end of the tubing head, the completion flange comprising a completion flange lock screw port aligned with the tubing head lock screw port; and (b) a lock screw extending through the tubing head and completion flange lock screw ports and abutting against the upper tubing hanger shoulder.

28. A wellhead assembly as claimed in claim 22 wherein the casing head comprises an inner surface having a casing head shoulder, the tubing head comprises an outer surface having a tubing head shoulder, and the tubing head shoulder rests on the casing head shoulder.

29. A wellhead assembly as claimed in claim 22 wherein the tubing head is fluted and the casing head comprises an outlet plug that extends into the interior of the casing head and into a flute on the tubing head.

* * * * *